United States Patent [19]

Butseniex et al.

[11] 4,170,713

[45] Oct. 9, 1979

[54] CHANNEL-TYPE INDUCTION FURNACE

[76] Inventors: Imant E. Butseniex, ulitsa Mira 19, kv. 14, Salaspils; Margarita Y. Levina, ulitsa Sormouskaya 10, korpus 1, kv. 29, Moscow; Alexandr A. Prostyakov, ulitsa Veshnyakovskaya 35/26, kv. 66, Moscow; Mikhail Y. Stolov, ulitsa Volochaevskaya 40a, kv. 36, Moscow; Vladimir I. Sharamkin, ulitsa Mira 16/7 kv. 313; Eduard V. Scherbinin, ulitsa Mira 16/6, kv. 21, both of Salaspils, all of U.S.S.R.

[21] Appl. No.: 894,386

[22] Filed: Apr. 7, 1978

[30] Foreign Application Priority Data

Apr. 7, 1977 [SU] U.S.S.R. ..... 2475290
Jul. 14, 1977 [SU] U.S.S.R. ..... 2507843

[51] Int. Cl.[2] ..... H05B 5/14
[52] U.S. Cl. ..... 13/29

[58] Field of Search ..... 13/29, 30

[56] References Cited

U.S. PATENT DOCUMENTS

| | | | |
|---|---|---|---|
| 2,539,800 | 1/1951 | Tama | 13/29 |
| 3,092,682 | 6/1963 | Tama et al. | 13/29 |
| 3,595,979 | 7/1971 | Shearman | 13/29 |

*Primary Examiner*—Roy N. Envall, Jr.
*Attorney, Agent, or Firm*—J. Harold Nissen

[57] ABSTRACT

A channel-type induction furnace comprises a hearth for molten metal, at least one closed transformer core with a coil arranged thereabout and connected to a suitable source of alternating current, at least three channels communicating with the hearth and connected with one another through a horizontal channel, two tubular members each disposed in the hearth in a manner to adjoin the inlet opening of the lateral channel and formed of a non-conducting refractory material.

11 Claims, 3 Drawing Figures

CHANNEL-TYPE INDUCTION FURNACE

BACKGROUND OF THE INVENTION

1. Field of the Application

The present invention relates to apparatus for melting metals, and more particularly to a channel-type induction furnace.

The invention is applicable for use in manufacturing channel-type induction furnaces provided with a plurality of induction coils and intended for holding liquid metals and melting solid metals and alloys.

2. Description of the Prior Art

There is known a channel-type induction furnace which comprises a hearth and the so-called induction unit which may include one or more transformer cores mounting induction coils with channels being disposed therebetween and communicating with the hearth, said channels communicating with one another through a horizontal channel and containing a molten metal.

The above-mentioned melting channels form loops which embrace the induction coils. With the induction coils being connected to an a.c. power source, the electric current passes through the channels to result in the heat energy generated in the molten metals contained in said channels. The released heat is then transferred to the molten metal contained in the furnace hearth.

The best operating conditions of the furnace are such that provide for great velocity of molten metal flow through the channels. This makes it possible to effectively transfer the heat generated in the channels to the metal found in the hearth, permits the temperature of the molten metal found in the channels to be decreased, and, finally, enables the provision of channel-type induction furnaces having high operative capacity and long service life of the refractory lining.

U.S. Pat. No. 2,539,800 discloses a channel-type induction furnace which comprises two induction coils and three intercommunicating channels connected with one another through a horizontal channel (the so-called twin coil induction unit). In order to provide for unidirectional flow of metal to the inlet opening of the central channel, a tubular member of electrically conductive refractory material is mounted so as to intimately adjoin the inlet opening of said channel.

Owing to the use of electrically conductive material, the electric current passing through the channel follows the same path with or without the presence of the tubular member, whereas the metal is caused to move by reason of "electromagnetic pumping" or "pinch effect" along the path extending through the hearth, lateral channels, horizontal channels, central channel and back to the hearth again. The furnace construction in question have not found wide application because of the low velocity of metal flow.

U.S. Pat. No. 3,595,979 describes a channel-type induction furnace construction now in wide use wherein a unidirectional flow of liquid metal passes through the channels of the twin coil induction unit. The unidirectional flow of metal in this furnace construction is ensured due to a special shape given to the inlet opening of the central channel. Let us consider this at greater length. The distribution of the electric current passing through the twin induction units results in the appearance of eddies or turbulence in the inlet openings of the lateral and central channels. These eddies cause the metal to eject from the channels. Since the eddies act with different intensity in the central channel and in the lateral channels, the melt is pumped through said channels. With the inlet end of the central channel outflaring in two directions, turbulence becomes more vigorous in this area, thus allowing for a unidirectional flow of metal. However, due to stagnation in the movement of metal inside of the melting channels, i.e. the metal moves in a counter-current flow to the unidirectional flow of metal at certain places of the inlet opening of the channel, the velocity of the metal unidirectional flow is reduced under the effect of turbulence at the inlet openings of the lateral channels.

In the course of the furnace operation the inlet openings of the channels change their shape, increasing or decreasing in cross section under the action of molten metal, whereby the velocity of molten metal flow is reduced in the known furnace construction. This, in turn, causes the overheating of metal contained in the channel and leads to premature failure of the induction unit.

OBJECTS OF THE INVENTION

The primary object of the invention is to increase the velocity of a unidirectional flow of metal through the channels of an induction unit and to thereby reduce the overheating of metal in the channel, thus enhancing the operative capacity and production efficiency of furnaces.

Another object of the invention is to prolong service life of the furnace refractory lining.

Still another object of the invention is to improve mass exchange in the furnace hearth, which makes it possible to attain high degree of chemical homogeneity of the metal while maintaining it at a uniform temperature.

SUMMARY OF THE INVENTION

The invention provides a channel-type induction furnace comprising a hearth for molten metal, at least three channels interconnected through a horizontal channel and communicating with the hearth, one of said channels having a tubular member intimately adjoined to its inlet opening, and at least one closed transformer core mounting at least two coils connected to a suitable source of alternating current, wherein, according to the invention, there is additionally mounted a second tubular member, the both tubular members being formed of an electrically non-conductive refractory material and adjoining the inlet openings of the lateral channels.

It is preferable that each tubular member should be more than twice larger in height than the lateral channel in width in the direction perpendicular to the longitudinal axis of the coil.

Each tubular member is preferably formed with three walls of the hearth from the side of the inlet opening of the lateral channel and with a partition positioned transversely of the hearth.

The partition is preferably disposed away from the oppositely spaced wall of the hearth at a distance less than that from the same wall to the symmetry axis of the coil, disposed in direct proximity to the same partition.

Such furnace construction allows the velocity of molten metal flow to be increased twice or more times as much compared to the prior-art furnace constructions, makes it possible to decrease the overheating of metal in the channel, to prolong the service life of the refractory lining of the induction units, to enhance the operative capacity and production efficiency of induction furnaces.

BRIEF DESCRIPTION OF THE DRAWINGS

The invention will be further described, by way of example only, with reference to the accompanying drawings, wherein.

DETAILED DESCRIPTION OF THE PREFERRED EMBODIMENTS

Figure 1:
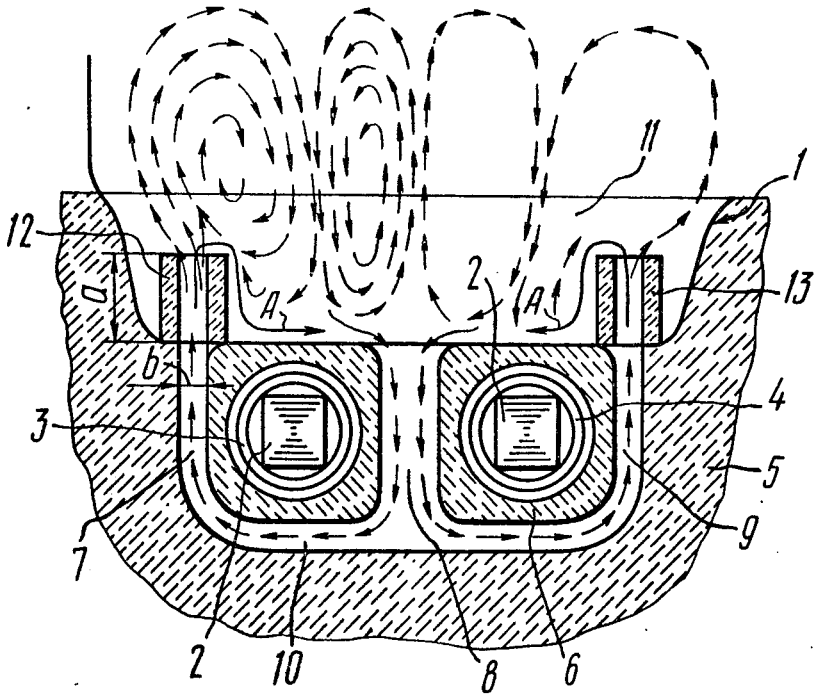
FIG. 1 is a longitudinal sectional view of a channel-type induction furnace according to the invention.

Referring now to the drawings in detail and to FIG. 1 in particular, there is shown therein a channel-type induction furnace which comprises a hearth 1 for molten metal and a twin coil induction unit incorporating a closed transformer core 2 which mounts induction coils 3, 4 connected to a suitable source of alternating current. It is possible that only one induction coil can be arranged around the transformer core 2. This being the case, the number of coils will correspond to the number of closed transformer cores going around the melting channels. FIG. 1 shows the embodiment of the invention, in which two coils are arranged around the transformer core 2.

Formed between the walls of the lined housing 5 of the induction unit and a refractory lining 6 of the coils are channels 7, 8 and 9 which are interconnected with one another through a horizontal channel 10. The channels 7, 8, 9 open into the hearth 1 and thus communicate with a cavity II of the hearth 1.

FIG. 1 shows the preferred embodiment of the invention which is formed with three channels, two lateral channels indicated by 7 and 9, and one central channel indicated by 8. The central channel 8, however, can number more than one, depending upon the number of coils arranged in the induction unit.

Mounted in the hearth 1 are two tubular members 12 and 13. Each of the tubular members adjoins the inlet opening of the respective lateral channel 7 or 9, with the resultant alteration in the electric current distribution pattern at the place of its exit from the tubular members 12, 13.

Figure 2:
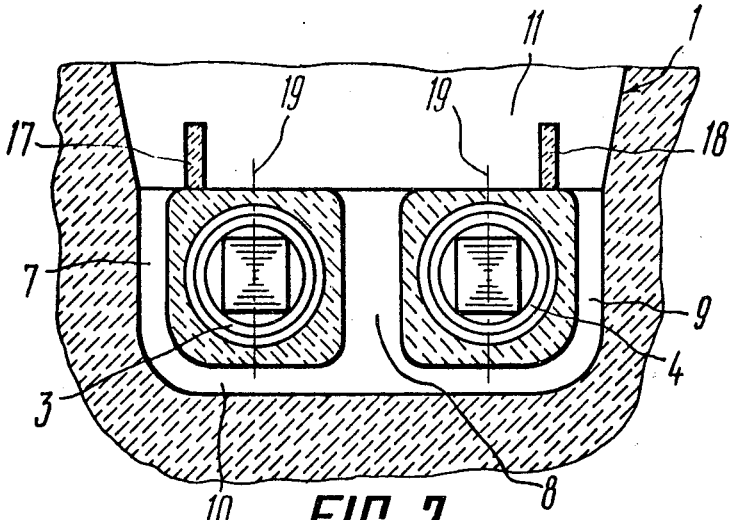
FIG. 2 is a longitudinal sectional view of another embodiment of the invention.
Figure 3:
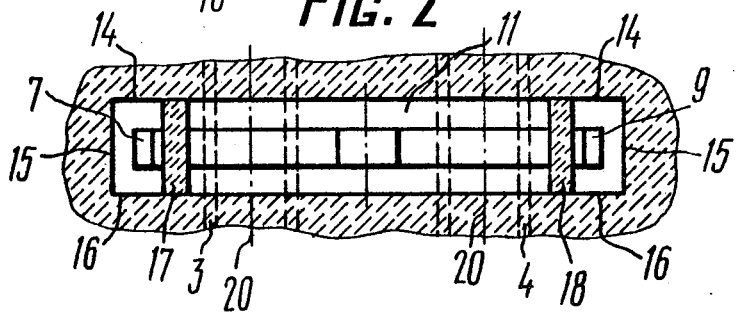
FIG. 3 is a cross-sectional view of a channel-type induction furnace formed with partitions, according to the invention.

According to another embodiment of the invention, each tubular member 12, 13 is formed with three walls 14, 15, 16 (FIGS. 2, 3) of the hearth 1 and with a partition 17 or 18 mounted in the cavity II across the width of the hearth I, such as shown in FIG. 3.

The partition 17 (18) can be positioned at any place within a distance from the inlet opening of the respective lateral channel 7 (9) to the symmetry axis 19 of the coil 3 (4), disposed in direct proximity with the channel 7 (9).

Tubular members are preferably formed of an electrically non-conducting refractory material, which makes it possible for them to alter the travelling path of current induced in the molten metal.

To attain a greater velocity of molten metal flow, the height "a" (FIG. 1) of the tubular members 12, 13 is more than two times the width "b" of the lateral channels 7 and 9 in the direction perpendicular to the longitudinal axis 20 of the coil 3 (4).

In the channel-type induction furnace construction of the invention the electric current induced in the melting chamber by-passes the tubular members 12, 13 in a circular path, shown in FIG. 1 by arrow A, which is due to the fact that said tubular members are made of a refractory non-conductive material.

As a result of this, the intensity of magnetic field is materially increased in the current distribution zone at the outlet from the tubular member 12 or 13, as well as electromagnetic forces proportional to the induction of magnetic field, with eddies or turbulence becoming vigorous in the area of the tubular member 12 or 13. In addition, the eddies cease to flow into the lateral channels 7, 9, since the wall of the tubular members 12, 13 serves as a guide for the turbulent flow, directing the vector of its speed upwardly into the furnace hearth 1.

Thus the metal circulates within the furnace in a circular path, such as shown in FIG. 1 by arrows B, at a speed two or more times the speed of molten metal flow in the prior-art furnaces.

The metal flow velocity in the furnace construction according to the present invention is 2 to 5 times greater than that in the prior-art furnace constructions. It should be observed that the velocity of metal flow increases with a height of the tubular member until its value exceeds two times that of the channel width, whereupon this change becomes insignificant.

What is claimed is:

1. A channel-type induction furnace comprising: a hearth adapted to contain molten metal and having a cavity defined by walls, at least one closed transformer core; coils supplied with alternating current, arranged around said transformer core and operable to induce current in the metal; a housing adapted to accommodate said transformer core with said coils so that the walls of said housing form at least three vertical channels and one horizontal channel through which passes a flow of molten metal; said channels communicating with said cavity of the hearth; said horizontal channel interconnecting said vertical channels with one another; two tubular members formed of an electrically non-conductive refractory material and mounted so that each said member adjoins the inlet opening of one of said vertical channels which are lateral channels.

2. A channel-type induction furnace as claimed in claim 1, wherein each tubular member is more than twice larger in height than each said lateral channel in width in the direction perpendicular to the longitudinal axis of said coil.

3. A channel-type induction furnace as claimed in claim 1, comprising: a partition arranged across the width of said hearth, and said tubular members formed with the walls of said hearth from the side of the inlet opening of said lateral channel and with said partition.

4. A channel-type induction furnace as claimed in claim 2, comprising: a partition arranged across the width of said hearth, said tubular members being formed by said walls of said hearth from the side of the inlet opening of said lateral channel and with said partition.

5. A channel-type induction furnace as claimed in claim 3, comprising said partition arranged in said hearth and disposed away from the oppositely spaced wall of said hearth at a distance less than that from the same wall to the symmetry axis of said coil, disposed in direct proximity to the same partition.

6. The channel-type induction furnace as claimed in claim 1, wherein each said tubular member has a substantially vertical outer wall surface on the side facing the center of the hearth, to cause electric current induced in molten metal contained in the hearth, to follow a sharply turning path and thereby materially increase the intensity of the magnetic field at the outlet of each said tubular member.

7. The channel-type induction furnace as claimed in claim 3, wherein said partition is substantially vertical.

8. In a channel-type induction furnace of the type comprising: a hearth adapted to contain molten metal and having a cavity defined by walls; at least one closed transformer core; coils supplied with alternating current, arranged around said transformer core and operable to induce current in the metal; a housing adapted to accommodate said transformer core with said coils so that the walls of said housing form at least one central vertical channel, two outer vertical channels and one horizontal channel, through which pass a flow of molten metal; said vertical channels communicating with said cavity of said hearth; said horizontal channel interconnecting said vertical channels with one another; each of said outer vertical channels having a separate one of said coils associated therewith to induce electric current flow in molten metal contained therein, the improvement comprising two tubular members formed of electrically non-conducting refractory material;

a first of said tubular members being adjoined with and extending upwardly of a first said outer vertical channels, and a second said tubular member being adjoined to and extending upwardly of a second said outer vertical channels;

said first tubular member having a first upright wall disposed between said first outer vertical channel and said central vertical channel and no closer to said central vertical channel than the symmetry axis of the coil associated with said first vertical outer channel.

9. The channel-type induction furnace of claim 8 wherein said second tubular member includes a second upright wall disposed between said second outer vertical channel and said central vertical channel and no closer to said second central vertical channel than the symmetry axis of the coil associated with said second vertical outer channel.

10. The channel-type induction furnace of claim 9 wherein each said vertical wall is in the form of a partition wall, and each said tubular member is defined by a respective partition wall and a wall of said hearth.

11. The channel-type induction furnace of claim 8 wherein said first upright wall is in the form a a partition wall and said first tubular member is defined by said partition wall and a wall of said hearth.

* * * * *